US007842208B2

(12) United States Patent
Krins et al.

(10) Patent No.: US 7,842,208 B2
(45) Date of Patent: Nov. 30, 2010

(54) SPINNING METHOD

(75) Inventors: Bastiaan Krins, Emmen (NL); Johannes Frederik Boer, Arnhem (NL)

(73) Assignee: Diolen Industrial Fibers B.V., Arnhem (NL)

( * ) Notice: Subject to any disclaimer, the term of this patent is extended or adjusted under 35 U.S.C. 154(b) by 0 days.

(21) Appl. No.: 12/452,666

(22) PCT Filed: Jul. 16, 2008

(86) PCT No.: PCT/EP2008/005783

§ 371 (c)(1), (2), (4) Date: Jan. 14, 2010

(87) PCT Pub. No.: WO2009/012916

PCT Pub. Date: Jan. 29, 2009

(65) Prior Publication Data

US 2010/0186364 A1 Jul. 29, 2010

(30) Foreign Application Priority Data

Jul. 21, 2007 (EP) ..... 07014367

(51) Int. Cl.
*D01D 5/092* (2006.01)
*D01D 5/16* (2006.01)
*D02J 1/22* (2006.01)

(52) U.S. Cl. ..... 264/101; 264/103; 264/210.7; 264/210.8; 264/211.12; 264/211.14; 264/211.15

(58) Field of Classification Search ..... 264/101, 264/103, 210.8, 211.12, 211.14, 211.15, 264/210.7

See application file for complete search history.

(56) References Cited

U.S. PATENT DOCUMENTS

| | | | | |
|---|---|---|---|---|
| 2002/0121724 | A1 | 9/2002 | Schafer | |
| 2005/0140067 | A1 * | 6/2005 | Berrigan et al. | 264/518 |
| 2005/0147814 | A1 | 7/2005 | Middeljans et al. | |

FOREIGN PATENT DOCUMENTS

| | | | |
|---|---|---|---|
| JP | A-03-234811 | | 10/1991 |
| WO | WO 96/20299 | A1 | 7/1996 |
| WO | WO 01/18288 | A1 | 3/2001 |
| WO | WO 2004/005594 | A1 | 1/2004 |

OTHER PUBLICATIONS

International Search Report issued in International Application No. PCT/EP2008/005783 on Apr. 15, 2009 (with English-language translation).

* cited by examiner

*Primary Examiner*—Leo B Tentoni
(74) *Attorney, Agent, or Firm*—Oliff & Berridge, PLC

(57) ABSTRACT

A method for spinning a multifilament yarn from a thermoplastic material, where the filament bundle is cooled below the spinneret in a first cooling zone, first of all by means of at least one transverse blowing operation with a gaseous cooling medium and by means of an extraction means for the gaseous cooling medium which lies opposite said transverse blowing means, and subsequently the filament bundle is cooled further in a second cooling zone below the first cooling zone by automatic suction of gaseous cooling medium which is situated in the vicinity of the filament bundle.

18 Claims, 1 Drawing Sheet

SPINNING METHOD

Figure 1:
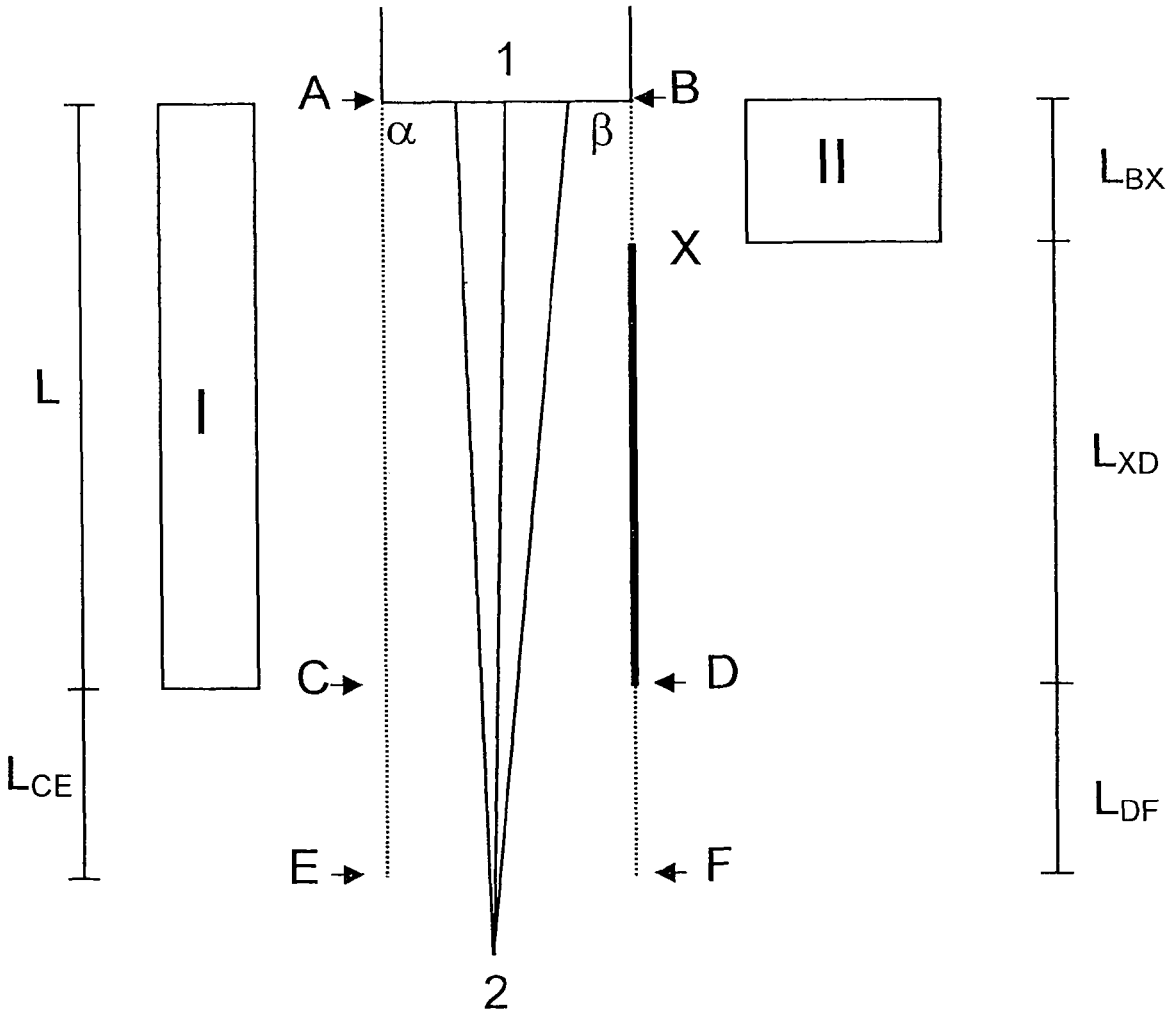

The present invention relates to a method for spinning a multifilament yarn from a thermoplastic material comprising the steps of extruding the melted material through a spinneret with a plurality of spinneret holes to form a filament bundle comprising a plurality of filaments, winding the filament bundle as a multifilament yarn after solidifying, and cooling the filament bundle below the spinneret.

The present invention also relates to multifilament yarns, in particular polyester filament yarns and cords containing such polyester filament yarns.

A method as described above is known from WO 2004/005594. The filament bundle is thereby cooled below the spinneret in two stages with the filament bundle first being cooled below the spinneret in a first cooling zone by means of a transverse blowing operation with gaseous cooling medium and by means of suction on the opposite side to the transverse blowing operation, and then in a second cooling zone below the first cooling zone the filament bundle being further cooled essentially by self suction of gaseous cooling medium in the vicinity of the filament bundle. Although the method described in WO 2004/005594 results in effective cooling of the extruded filaments, there is a need to be able to spin a multifilament yarn with a high overall linear density, a dimensional stability at least as good as the dimensional stability of the yarns resulting from the method described in WO 2004/005594, and an acceptable running behaviour.

In this context the term "dimensional stability", abbreviated hereinafter to 'Ds', means the sum of the elongation of the yarn in % after applying a specific force of 410 mN/tex ("elongation at specific tension") EAST and the hot air shrinkage HAS in % at 180° C., a pretension of 5 mN/tex and over a measuring time of 2 minutes, i.e. Ds=EAST+HAS, whereby HAS stands for the absolute value of the hot air shrinkage.

Furthermore, the term "running behaviour" means the fluff count per 10 kg of yarn and the yarn breakage rate per 1000 kg of yarn.

The object of the present invention is therefore to provide a method by means of which a multifilament yarn with a high overall linear density, a dimensional stability at least as good as the dimensional stability of the yarns resulting from the method described in WO 2004/005594, and an acceptable running behaviour can be spun from a thermoplastic material.

This object is achieved by a method for spinning a multifilament yarn from a thermoplastic material comprising the steps of extruding the melted material through a spinneret to form a filament bundle comprising a plurality of filaments and winding the filament bundle as a multifilament yarn after solidifying, said spinneret having a plurality of spinneret holes and the ends of the holes from which the filaments emerge forming a spinneret hole outlet plane, and with the filament bundle thereby first being cooled below the spinneret in a first cooling zone by means of at least one transverse blowing operation with a gaseous cooling medium and by means of suction on the opposite side to the transverse blowing operation, and then in a second cooling zone below the first cooling zone the filament bundle being further cooled by self suction of gaseous cooling medium in the vicinity of the filament bundle, characterised in that in the first cooling zone the at least one transverse blowing operation occurs via a blowing section AC of length L with the blowing section AC having an upper leading end A facing towards the spinneret holes and a lower trailing end C facing away from the spinneret holes, and that the blowing section AC is arranged opposite a section BD having a leading end B facing towards the spinneret holes and a trailing end D facing away from the spinneret holes, and that the imaginary line AB between A and B runs parallel to the spinneret hole outlet plane, with section BD having the length L and section BD being divided into an open suction section BX with the length $L_{BX}$ via which the gaseous cooling medium is sucked away and a closed section XD having the length $L_{XD}$, with the $L_{BX}$:$L_{XD}$ ratio lying in the range between 0.15:1 and 0.5:1.

Using the inventive method it is surprisingly possible to spin filament bundles of thermoplastic material directly from the spinneret ("direct spinning") without any sticking whose overall linear density is 1800 dtex and higher, and whose running behaviour, i.e. the fluff count per 10 kg of yarn and also the yarn breakage rate per 1000 kg of yarn, is considerably better than that of a multifilament yarn whose production method described in WO 2004/005594 differs from the inventive method only in that the extraction of the gaseous cooling medium in the first cooling zone takes place over the whole length BD=L. Furthermore, the dimensional stability of the resulting multifilament yarn, Ds=EAST+HAS, is at least as good as the Ds of the yarns resulting from the method described in WO 2004/005594.

Even when spinning multifilament yarns with an overall linear density below 1800 dtex, the inventive method improves the quality of the spinning process compared with the method described in WO 2004/005594 in the form of a significantly reduced fluff count per 10 kg of yarn and an also significantly lower yarn breakage rate per 1000 kg of yarn with an at least equally good dimensional stability.

In order to achieve the above-mentioned advantageous effects of the inventive method it is essential for the invention that the section BD is divided into an open suction section BX with the length $L_{BX}$ via which the gaseous cooling medium is sucked away, and a closed section XD with the length $L_{XD}$, with the $L_{BX}$:$L_{XD}$ ratio lying in the range between 0.15:1 and 0.5:1.

If the section BD is not divided into an open suction section BX with the length $L_{BX}$ and a closed section XD with the length $L_{XD}$ so that the extraction in the first cooling zone takes place over the whole length BD=L, then with otherwise identical process conditions

- either such intensive sticking of the filaments occurs that it is completely impossible to spin a filament yarn with an overall linear density of 1800 dtex or even higher (black-and-white effect),
- or the spinning of a multifilament yarn with an overall linear density of 1800 dtex or higher is possible by reducing the draw ratio, but a multifilament yarn is obtained with unacceptably high values for the fluff count per 10 kg of yarn and for the yarn breakage rate per 1000 kg of yarn. Furthermore, the dimensional stability of the yarn is too low, i.e. the value for Ds=EAST+HAS is too high.

Although it is possible to spin a filament bundle with an overall linear density below 1800 dtex even with an suction section open over the whole length BD=L, with otherwise identical conditions to those in the inventive method the fluff count and the yarn breakage rate is significantly higher than in the inventive method.

According to the invention, the $L_{BX}$:$L_{XD}$ ratio lies in the range between 0.15:1 and 0.5:1. With an $L_{BX}$:$L_{XD}$ ratio smaller than 0.15:1, the cooling effect exerted on the filaments is insufficient and the filaments stick together. With an $L_{BX}$:$L_{XD}$ ratio larger than 0.5:1, no sufficiently stable running behaviour can be obtained.

In a preferred embodiment of the inventive method, the $L_{BX}$:$L_{XD}$ ratio lies in the range between 0.2:1 and 0.4:1, particularly preferred in the range between 0.25:1 and 0.35:1, and most particularly preferred in the range between 0.27:1 and 0.33:1.

The absolute length $L_{BX}$ of the suction section BX and the absolute length of the closed section $L_{XD}$ of the closed section XD can—as long as the resulting $L_{BX}$:$L_{XD}$ ratio lies within the inventive range—be varied within broad limits. In order to make the advantageous effects of the inventive method particularly pronounced, it is preferred that $L_{BX}$ has a length in the range from 5 cm to 50 cm and $L_{XD}$ a length in the range from 20 cm to 150 cm. More preferred, the inventive method is performed with values for $L_{BX}$ in the range from 10 cm to 25 cm and with values for $L_{XD}$ in the range from 35 cm to 75 cm. Most preferred, the inventive method is performed with values for $L_{BX}$ in the range from 12 cm to 21 cm and with values for $L_{XD}$ in the range from 49 cm to 58 cm.

According to the invention, the imaginary line between A and B runs parallel to the spinneret hole outlet plane. The blowing section AC forms an angle α and the suction section BX an angle β relative to the imaginary line AB, whereby the values for α and β can be the same or different. In a preferred embodiment of the inventive method, the blowing section AC forms an angle α of 60° to 90° relative to the imaginary line AB, and the suction section BX forms an angle β of 60° to 90° relative to the imaginary line AB.

In a particularly preferred embodiment of the inventive method, the blowing section AC forms an angle α of 90° relative to the imaginary line AB, and the suction section BX forms an angle β of 90° relative to the imaginary line AB.

In a further particularly preferred embodiment of the inventive method, the blowing section AC forms an angle α of 60° to <90° relative to the imaginary line AB, and the suction section BX forms an angle β of 90° relative to the imaginary line AB.

When performing the inventive method it is fundamentally possible for the angle β that the suction section BX forms relative to the imaginary line AB to be different from the angle β' that the section XD forms relative to the imaginary line AB. However, the inventive method is preferably performed such that the angles β and β' are equal.

In the inventive method, the filament bundle is being cooled in the first cooling zone by means of the transversely blown gaseous cooling medium and by means of suction via the suction section BX on the opposite side to the transverse blowing operation. This can be effected e.g. in such a way that the filament bundle is guided between the blowing section AC with the length L and the suction section BX with the length $L_{BX}$. Another possibility consists in splitting the filament stream and, for example, to set up a blowing section AC with the length L, e.g. in the form of a perforated tube with the length L, in the middle between two filament streams in the first cooling zone. In this embodiment the gaseous cooling medium can then be blown from the middle of the filament bundles via the blowing section AC with the length L and out through the filament bundles to the outside and be sucked away via the suction section BX with the length $L_{BX}$. Furthermore, the inventive method can also be performed in that a perforated tube running through the middle of the filament streams serves as suction section BX with the length $L_{BX}$ and sucks away the gaseous cooling medium that is blown transversely from the outside to the inside via the blowing section AC with the length L.

It is preferable for the inventive method if the flow velocity of the gaseous cooling medium in the first cooling zone lies between 0.1 and 1 m/s. At these velocities, uniform cooling is achieved more or less without intermingling and without the formation of skin/core differences during crystallisation.

In a further preferred embodiment of the inventive method, the gaseous cooling medium is tempered, i.e. cooled or heated, by means of a first temperature control device before it is supplied to the at least one transverse blowing operation in the first cooling zone. This embodiment allows the process to be controlled independently of the ambient temperature, and thus has a beneficial effect on the long term stability of the process, e.g. with respect to day/night or summer/winter differences.

The second stage of the cooling in the inventive method is performed by self-suction ("self-suction yarn cooling"). The filament bundle thereby drags the gaseous cooling medium in its vicinity, e.g. ambient air, with it and is thereby further cooled. In this case a flow of the gaseous cooling medium occurs that is more or less parallel to the running direction of the filament bundle. It is important here that the gaseous cooling medium comes into contact with the filament bundle from at least two sides.

In the inventive method this can be achieved by the self-suction unit being formed by two perforated materials running parallel to the filament bundle, such as perforated plates. The length of the plates is at least 10 cm and can extend to several metres. Quite common lengths for this self-suction section lie between 30 cm and 150 cm, and these are also suitable for the inventive method.

A preferred embodiment of the inventive method can be performed in the manner just described with the filament bundle being guided between perforated materials, such as perforated plates, in the second cooling zone in such a way that the gaseous cooling medium can contact the filaments from two sides due to the self-suction of the filaments in the filament bundle.

In a further preferred embodiment of the inventive method, the filament bundle is guided through a perforated tube in the second cooling zone. Such "self-suction tubes" are known to persons skilled in the art. They allow the gaseous cooling medium to be dragged along by the filament bundle in such a way that intermingling is mostly avoided. The perforated tube thereby has a porosity $P_{tube}=F_o/F$ in the range from 0.1 to 0.9 and particularly preferred in the range from 0.30 to 0.85, where $F_o$ is the open cylindrical surface of the tube and F the whole cylindrical surface of the tube.

The second cooling zone can, however, also be designed as a "self-suction zone" in such a way that a shaft with square or rectangular cross-section is formed whereby the walls of the shaft consist of two opposed closed plates and two opposed porous plates. Here the one porous plate has a porosity $P_1=F_{o1}/F_1$, where $F_{o1}$ is the open surface area of this plate and $F_1$ the total surface area of this plate. Furthermore, the other porous plate has a porosity $P_2=F_{o2}/F_2$, where $F_{o2}$ is the open surface area of this plate and $F_2$ the total surface area of this plate. The porosity of the one plate $P_1$ can thereby be the same as or different from the porosity $P_2$ of the other plate. The values for $P_1$ and $P_2$ preferably lie in the range from 0.1 to 0.9, particularly preferably in the range from 0.2 to 0.85.

It is possible to control the temperature of the cooling medium that is sucked in by the filament bundle in the second cooling zone, e.g. by the use of heat exchangers. This embodiment allows the process to be controlled independently of the ambient temperature, and thus has a beneficial effect on the long term stability of the process, e.g. with respect to day/night or summer/winter differences.

A heating tube is normally located between the spinneret or nozzle plate and the beginning of the first cooling zone. Depending on the filament type, this element well-known to a person skilled in the art is between 10 and 40 cm long.

As already mentioned, the inventive method comprises at least one transverse blowing operation for a gaseous cooling medium in the first cooling zone. This means that the first cooling zone can have not only a first transverse blowing operation, but also a second, third, etc. transverse blowing operation, with these transverse blowing operations being located immediately below one another on the blowing section AC and in total have a length of L. Each of these transverse blowing operations can fundamentally be operated with a blowing volume of gaseous cooling medium that can be set independently of the blowing volumes of gaseous cooling medium with which each of the other transverse blowing operations is operated. Furthermore, each of these transverse blowing operations can fundamentally be operated with a temperature of the gaseous cooling medium that can be set independently of the temperatures of the gaseous cooling media with which each of the other transverse blowing operations is operated.

In a preferred embodiment of the inventive method, the first cooling zone has a first transverse blowing operation and an immediately adjoining second transverse blowing operation on the blowing section AC, with the first and second transverse blowing operations together having a total length L, and with the first transverse blowing operation being operated with a flow velocity $v_{11}$ of the gaseous cooling medium and the second transverse blowing operation being operated with a flow velocity $v_{12}$ of the gaseous cooling medium, with $v_{11}$ being different from $v_{12}$.

In a further preferred embodiment of the inventive method, the first cooling zone has a first transverse blowing operation and an immediately adjoining second transverse blowing operation on the blowing section AC, with the first and second transverse blowing operations together having a total length L, and with the first transverse blowing operation being operated with a temperature $T_{11}$ of the gaseous cooling medium and the second transverse blowing operation being operated with a temperature $T_{12}$ of the gaseous cooling medium, with $T_{11}$ being different from $T_{12}$.

The two above-mentioned embodiments allow the cooling conditions in the first cooling zone to be adapted particularly accurately to changing cooling requirements.

The inventive method can also be performed in that the filament bundle in the second cooling zone is further cooled by self-suction of gaseous cooling medium in the vicinity of the filament bundle, with the temperature of the gaseous cooling medium being controlled before entering the second cooling zone.

In the inventive method, a gaseous cooling medium is used to cool the filament bundle. Within the context of the present invention, this can be understood as any gaseous medium suitable for cooling filament bundles without thereby influencing the properties of the resulting multifilament yarn in an undesirable manner, e.g. by forming undesirable reaction products from the gaseous cooling medium and the resulting multifilament yarn. Air and/or an inert gas such as nitrogen or argon is preferably used as gaseous cooling medium in the inventive method, whereby either the same or different gaseous cooling media can be employed in the first and second cooling zone.

In a preferred embodiment of the inventive method, a single or multi-stage drawing of the filaments is performed after cooling of the filament bundle in the second cooling zone and before winding. The inventive method is thus preferably a continuous spinning-drawing-winding process. The term 'drawing' here should be understood as all common methods known to a person skilled in the art for drawing the filaments. This can be performed, for example, bygodets, single or in duos, or by similar means. It should be expressly pointed out that drawing is related to both draw ratios larger than 1 and to such ratios that are smaller than 1. The latter ratios are commonly known to persons skilled in the art under the term 'relaxation'. Draw ratios both larger and smaller than 1 can thereby quite conceivably occur concurrently with the inventive method.

The total draw ratio is commonly calculated as the ratio of the drawing speed to the spinning speed of the filaments, i.e. the speed at which the filament bundles leave the cooling zones and are fixed at the first pair of godets of the drawing device. A typical constellation is, for example, a spinning speed of 2760 m/min, a drawing speed of 6000 m/min, an additional relaxation after drawing of 0.5%, i.e. a speed at the last roll of 5970 m/min. This results in a total draw ratio of 2.17.

According to the invention, speeds of at least 2000 m/min are thus preferred for the winding, in particular of at least 2500 m/min. In principle there are no limits to the maximum speed for the process within the scope of what is technically feasible. In general, however, about 8000 m/min is preferred for the maximum speed range for winding, most preferably 6500 m/min. With common total draw ratios of 1.5 to 3.0, ranges for the spinning speed result from approx. 500 to approx. 4000 m/min, preferably 2000 to 3500 m/min, and most preferably from 2500 to 3500 m/min.

A quenching cell that is known per se can also be located upstream of the drawing devices and downstream of the cooling zones.

The inventive method is suitable in principle for spinning a multifilament yarn from any thermoplastic material and is therefore not limited to specific thermoplastic materials. In fact the inventive method can be employed for spinning all thermoplastic materials that can be extruded to filaments, in particular for spinning a multifilament yarn from a thermoplastic polymer. The thermoplastic material to be employed in the inventive method will therefore be preferably chosen from a group comprising thermoplastic polymers, whereby the group can contain polyester, polyamide, polyolefin or also blends or copolymers of these polymers.

Most preferably the thermoplastic material to be employed in the inventive method consists essentially of polyethylene terephthalate.

FIG. 1 shows a schematic cross-section of an exemplary device for performing the inventive method:

At a spinneret 1, a multifilament thread, i.e. a filament bundle 2, is spun through a plurality of spinneret holes whose ends form a spinneret hole outlet plane. A device for a transverse blowing operation I blows gaseous cooling medium against the filament bundle 2. The transverse blowing is executed via a blowing section AC with the length L, where A is the upper leading end facing towards the spinneret holes and C is the lower trailing end of the blowing section AC facing away from the spinneret holes. Points A and C designate the upper and lower ends respectively of the first cooling zone. Located opposite the blowing section AC is a section BD with a leading end B facing towards the spinneret holes and a trailing end D facing away from the spinneret holes. A and B are located such that the imaginary line AB between A and B runs parallel to the spinneret hole outlet plane. The angle $\alpha$ between the imaginary line AB and the blowing section AC is 90°. The angle $\beta$ between the imaginary line AB and the section BD is also 90°. The section BD is divided into an open suction section BX with the length $L_{BX}$ via which the gaseous cooling medium is sucked away with a suction device II and a closed section XD with the length $L_{XD}$, with the $L_{BX}$:$L_{XD}$ ratio lying in the range between 0.15:1 and 0.5:1.

Immediately below the first cooling zone whose left-hand end is designated C and whose right-hand end is designated D, is a second cooling zone. C and D thus also mark the start of the left-hand and right-hand sides respectively of the second cooling zone. The second cooling zone is defined on the left by a perforated plate that forms a self-suction section CE with the length $L_{CE}$ via which the filament bundle 2 sucks in gaseous cooling medium simply by its movement. The second cooling zone is defined on the right by another perforated plate that forms a self-suction section DF with the length $L_{DF}$ via which the filament bundle 2 also sucks in gaseous cooling medium simply by its movement. The drawing and winding of the spun multifilament following the second cooling zone is not illustrated.

As already mentioned at the beginning, the inventive method permits for the first time the production of a multifilament yarn, in particular a polyester multifilament yarn, in a continuous spinning-drawing-winding process with an overall linear density of at least 1800 dtex, a dimensional stability Ds=EAST+HAS of not more than 11.0% and with a fluff count that is at least 5% lower than the fluff count of a polyester filament yarn spun under the same conditions, except that $L_{BX}$:$L_{XD}$=1.

Such a polyester multifilament yarn is thus also part of the present invention. The maximum value of the overall linear density can, in principle, thereby take on infinitely large values as explained in the following: The spinneret hole outlet plane mentioned at the beginning can be designed as part of a spinneret plate having a length and a width. By extending the spinneret plate in the width it is fundamentally possible to spin infinitely large overall linear densities using the inventive method. For practical considerations, however, a person skilled in the art will select an upper limit for the overall linear density of the polyester multifilament yarn that lies in the range from 1800 dtex to 5000 dtex, and preferably in the range from 2000 dtex to 3600 dtex.

In a preferred embodiment the polyester multifilament yarn has a dimensional stability Ds=EAST+HAS of max. 10.5%.

In a further preferred embodiment the polyester multifilament yarn has a breaking tenacity of more than 60 cN/tex, particularly preferably of more than 65 cN/tex.

In a further preferred embodiment the polyester multifilament yarn has a fluff count that is at least 50%, particularly preferably at least 60%, lower than the fluff count of a polyester filament yarn spun under the same conditions, except that $L_{BX}$:$L_{XD}$=1. For example, the fluff count is less than 500 per 10 kg of yarn, particularly preferably less than 250 per 10 kg of yarn.

In a further preferred embodiment the polyester multifilament yarn has a yarn breakage rate less than 25 per 1000 kg of yarn, particularly preferably less than 10 per 1000 kg of yarn.

The inventive polyester multifilament yarn is preferably characterised in that the yarn has a breaking tenacity T in mN/tex and an elongation at break E in %, whereby the product of the breaking tenacity T and the cube root of the elongation at break E, $T \cdot E^{1/3}$, is at least 1600 mN $\%^{1/3}$/tex and preferably between 1600 and 1800 mN $\%^{1/3}$/tex.

The measurements of the breaking tenacity T and of the elongation at rupture E for determining the parameter $T \cdot E^{1/3}$ are performed in accordance with ASTM 885 and are per se known to a person skilled in the art.

The fluff count per 10 kg of yarn is determined using the ENKA Tecnica FR V.

The number of yarn breakages per 1000 kg of yarn is determined by counting.

The measurement of the EAST is performed in accordance with ASTM 885 and the determination of the HAS is also performed in accordance with ASTM 885, on the condition that the measurement is performed at 180° C., with 5 mN/tex and over a measurement period of 2 minutes.

The above-mentioned polyester multifilament yarn is particularly well-suited for technical applications, in particular for use in tyre cord.

An undipped cord manufactured from the inventive polyester multifilament yarn exhibits a value for the product $T \cdot E^{1/3}$ that is at least 1375 mN $\%^{1/3}$/tex, and is preferably up to 1800 mN $\%^{1/3}$/tex. Such an undipped cord is thus also part of the present invention.

Finally the present invention covers a dipped cord comprising a polyester multifilament yarn manufactured using the inventive method with the cord exhibiting a retention capacity Rt after dipping and is characterised in that the quality factor $Q_f$, i.e. the product of $T \cdot E^{1/3}$ of the polyester multifilament yarn and Rt of the cord, is higher than 1350 mN $\%^{1/3}$/tex and is preferably up to 1800 mN $\%^{1/3}$/tex.

The retention capacity is to be understood as the dimensionless quotient of the breaking tenacity of the cord after dipping and the breaking tenacity of the threads.

The method is also well-suited to the production of technical yarns. The settings required for the spinning of technical yarns, in particular the choice of the spinneret hole and the length of the heating tube, are known to a person skilled in the art.

The invention is now explained in further detail by reference to the following examples, but without being limited to these examples.

EXAMPLE 1

Production of Polyethylene Terephthalate Multifilament Yarns with a Yarn Count of 2220 dtex Polyethylene terephthalate granules with a relative viscosity of 2.04 (measured on a solution of 1 g polymer in 125 g of a mixture of 2,4,6-trichlorophenol and phenol (TCF/F, 7:10 m/m) at 25° C. in an Ubbelohde (DIN 51562) viscosimeter) are spun, having selected $\alpha=\beta=90°$, and cooled. The spun filament bundle runs first through a heating tube, then through the first cooling zone immediately adjoining the heating tube and through the second cooling zone immediately adjoining the first cooling zone.

The first cooling zone thereby has a blowing section that is divided into a first transverse blowing operation followed immediately by a second transverse blowing operation by means of which the filament bundle is subjected to transverse flows of air each with different temperature and flow velocity. Opposite the first transverse blowing operation and immediately adjoining the heating tube is an open suction section of a given length via which the transversely blown air is sucked away at a given suction rate. Immediately adjoining the suction section is a closed section of given length.

Immediately adjoining the transverse blowing operation of the first cooling zone is the second cooling zone that is formed by a shaft comprising two opposite porous plates with different porosity, whereby the one plate is located below the blowing section of the first cooling zone and the second plate is located below the extraction section of the first cooling zone. In the second cooling zone, the filament bundle is cooled by the air that it draws in itself through the porous plates as a result of its movement. The spinning and cooling conditions are summarised in Table 1, where:

| | |
|---|---|
| L | Length of the blowing section in the first cooling zone |
| $T_{11}$ | Temperature of the air with which the filament bundle is blown transversely in the first transverse blowing operation of the first cooling zone; |
| $v_{11}$ | Flow velocity of the air with which the filament bundle is blown transversely in the first transverse blowing operation of the first cooling zone; |
| $L_{11}$ | Length of the first transverse blowing operation in the first cooling zone; |
| $T_{12}$ | Temperature of the air with which the filament bundle is blown transversely in the second transverse blowing operation of the first cooling zone; |
| $v_{12}$ | Flow velocity of the air with which the filament bundle is blown transversely in the second transverse blowing operation of the first cooling zone; |
| $L_{12}$ | Length of the second transverse blowing operation in the first cooling zone; |
| $L_{BX}$ | Length of the open suction section BX in the first cooling zone; |
| $L_{XD}$ | Length of the closed section XD in the first cooling zone; |
| V/t | Suction rate at which the air in the first cooling zone is drawn off through the open extraction section BX with the length $L_{BX}$; |
| $P_1$ | Porosity of the porous plate in the second cooling zone below the blowing section; |
| $P_2$ | Porosity of the porous plate in the second cooling zone below the extraction section; |
| $T_2$ | Temperature of the air sucked in by the filament bundle itself in the second cooling zone; |
| $L_{CE}$ | Length of the self-suction section in the second cooling zone. |

TABLE 1

| Spinning and cooling conditions | |
|---|---|
| Yarn count | 2200 [dtex] |
| Filament linear density | 4.4 [dtex] |
| Spinneret | |
| Number of holes | 501 |
| Hole diameter | 800 [μm] |
| Length of the heating tube | 150 [mm] |
| Temperature in the heating tube | 200 [° C.] |
| First cooling zone | |
| L | 700 [mm] |
| $T_{11}$ | 55 [° C.] |
| $v_{11}$ | 0.60 [m/min] |
| $L_{11}$ | 500 [mm] |
| $T_{12}$ | 30 [° C.] |
| $v_{12}$ | 0.85 [m/min] |
| $L_{12}$ | 200 [mm] |
| V/t | 230 [$m^3$/h] |
| $L_{BX}$ | 160 [mm] |
| $L_{XD}$ | 540 [mm] |
| $L_{BX}$:$L_{XD}$ | 0.30 |
| Second cooling zone | |
| $L_{CE}$ | 500 [mm] |
| $T_2$ | 30 [° C.] |
| $P_1$ | 0.32 |
| $P_2$ | 0.70 |

Immediately after passing through the second cooling zone, the multifilament is bundled and runs through a tube into a drawing device where the multifilament is drawn and wound under the draw ratios listed in Table 2 at a drawing speed of 6000 m/min to produce polyethylene terephthalate multifilament yarns manufactured in a single stage with a yarn count of 2200 dtex whose fluff counts and breaking tenacities, $T \cdot C^{1/3}$ values and dimensional stabilities Ds are also listed in Table 2 (see yarns No. 1-8).

COMPARATIVE EXAMPLE 1

For comparison, the polyethylene terephthalate multifilament threads No. V1-V6 are produced as in Example 1, but with the difference that in the first cooling zone suction is performed over the whole length BD=L=700 mm.

TABLE 2

Draw ratios, drawing speeds $v_s$, breaking tenacities T, $T \cdot E^{1/3}$ values, fluff counts and Ds values of the inventive polyethylene terephthalate multifilament yarns No. 1-8 and the comparative polyethylene terephthalate multifilament yarns No. V1-V6

| Example 1 | | | | | | | | |
|---|---|---|---|---|---|---|---|---|
| Thread No. | 1 | 2 | 3 | 4 | 5 | 6 | 7 | 8 |
| Draw ratio | 2.000 | 2.025 | 2.050 | 2.075 | 2.100 | 2.125 | 2.150 | 2.175 |
| $v_s$ [m/min] | 6000 | 6000 | 6000 | 6000 | 6000 | 6000 | 6000 | 6000 |
| T [mN/tex] | 607 | 633 | 621 | 635 | 647 | 667 | 670 | 689 |
| $T \cdot E^{1/3}$ [mN % $^{1/3}$/tex] | 1560 | 1588 | 1529 | 1564 | 1584 | 1617 | 1597 | 1628 |
| Fluff count | 160 | 129 | 244 | 157 | 132 | 212 | 257 | 417 |
| Ds [%] | 11.0 | 10.6 | 10.9 | 11.0 | 11.0 | 10.9 | 11.0 | 10.9 |

| Comparative example 1 | | | | | | | | |
|---|---|---|---|---|---|---|---|---|
| Thread No. | V1 | V2 | V3 | V4 | V5 | V6 | — | — |
| Draw ratio | 2.000 | 2.025 | 2.050 | 2.075 | 2.100 | 2.125 | — | — |
| $v_s$ [m/min] | 6000 | 6000 | 6000 | 6000 | 6000 | 6000 | — | — |
| T [mN/tex] | 617 | 633 | 622 | 663 | 656 | 651 | — | — |
| $T \cdot E^{1/3}$ [mN % $^{1/3}$/tex] | 1561 | 1569 | 1529 | 1621 | 1568 | 1570 | — | — |
| Fluff count | 172 | 405 | 687 | 876 | 977 | 1265 | — | — |
| Ds [%] | 11.0 | 11.2 | 11.3 | 11.1 | 11.1 | 11.4 | — | — |

The comparison of the fluff counts of the yarns 1-6 produced using the inventive method with the fluff counts of the comparative yarns V1-V6 shows that the inventive method results in yarns with a significantly lower fluff count and hence in a considerably improved running behaviour of the multifilament. The reduction in the fluff count in this example lies between 7% (compare yarn 1 with comparative yarn V1) and 86% (compare yarn 5 with comparative yarn V5). The dimensional stability Ds of the inventively produced yarns is thereby max. 11.0% and under otherwise identical conditions is equally good as or even better than the Ds of the comparative yarns V1-V6. Furthermore, the inventively produced yarns 7 and 8 show that with the inventive method it is possible to produce yarns with a yarn count of 2200 dtex, high strength and a fluff count that permits continuous spinning. By contrast, the attempt to set a draw ratio of 2.150 under the conditions of the comparative example at a drawing speed of 6000 m/min results in such intensive sticking of the filaments that continuous spinning is impossible. This applies in particular to the attempt to set a draw ratio of 2.175 under the conditions described. Finally the inventively produced yarns 6 and 8 show that it is possible with the inventive method to bring the $T \cdot E^{1/3}$ values into the preferred range of at least 1600 mN $\%^{1/3}$/tex by selecting a suitable draw ratio.

EXAMPLE 2

Production of Polyethylene Terephthalate Multifilament Yarns with a Yarn Count of 1670 dtex Polyethylene terephthalate granules with a relative viscosity of 2.04 (measured on a solution of 1 g polymer in 125 g of a mixture of 2,4,6-trichlorophenol and phenol (TCF/F, 7:10 m/m) at 25° C. in an Ubbelohde (DIN 51562) viscosimeter) were spun, having selected $\alpha=\beta=90°$. As in Example 1, the spun filament bundle runs through a heating tube, then through the immediately adjoining first cooling zone and through the immediately adjoining second cooling zone. The spinning and cooling conditions are summarised in Table 3, whereby the spinning and cooling parameters have the same meaning as in Example 1.

TABLE 3

| Spinning and cooling conditions | |
|---|---|
| Yarn count | 1670 [dtex] |
| Filament linear density | 4.1 [dtex] |
| Spinneret | |
| Number of holes | 412 |
| Hole diameter | 800 [μm] |
| Length of the heating tube | 150 [mm] |
| Temperature in the heating tube | 200 [° C.] |
| First cooling zone | |
| L | 700 [mm] |
| $T_{11}$ | 55 [° C.] |
| $v_{11}$ | 0.60 [m/min] |
| $L_{11}$ | 500 [mm] |
| $T_{12}$ | 55 [° C.] |
| $v_{12}$ | 0.85 [m/min] |
| $L_{12}$ | 200 [mm] |
| V/t | 230 [$m^3$/h] |
| $L_{BX}$ | 160 [mm] |
| $L_{XD}$ | 540 [mm] |
| $L_{BX}$:$L_{XD}$ | 0.30 |
| Second cooling zone | |
| $L_{CE}$ | 500 [mm] |
| $T_2$ | 30 [° C.] |
| $P_1$ | 0.23 |
| $P_2$ | 0.32 |

Immediately after passing through the second cooling zone, the multifilament is bundled and runs through a tube into a drawing device where the multifilament is drawn and wound under the draw ratios listed in Table 4 at a drawing speed of 6000 m/min to produce polyethylene terephthalate multifilament yarns manufactured in a single stage with a yarn count of 1670 dtex whose fluff counts and breaking tenacities, $T \cdot E^{1/3}$ values and dimensional stabilities Ds are also listed in Table 4 (see yarns No. 1-9).

COMPARATIVE EXAMPLE 2

For comparison, the polyethylene terephthalate multifilament yarns No. V1-V9 were produced as in Example 2, but with the difference that in the first cooling zone suction was performed over the whole length BD=L=700 mm.

TABLE 4

Draw ratios, drawing speeds $v_s$, breaking tenacities T, $T \cdot E^{1/3}$ values, fluff counts and Ds values of the inventive polyethylene terephthalate multifilament yarns No. 1-9 and the comparative polyethylene terephthalate multifilament yarns No. V1-V9

| Example 2 | | | | | | | | | |
|---|---|---|---|---|---|---|---|---|---|
| Thread No. | 1 | 2 | 3 | 4 | 5 | 6 | 7 | 8 | 9 |
| Draw ratio | 2.000 | 2.025 | 2.050 | 2.075 | 2.100 | 2.125 | 2.150 | 2.175 | 2.200 |
| $v_s$ [m/min] | 6000 | 6000 | 6000 | 6000 | 6000 | 6000 | 6000 | 6000 | 6000 |
| T [mN/tex] | 622 | 646 | 666 | 645 | 680 | 702 | 694 | 699 | 740 |
| $T \cdot E^{1/3}$ [mN $\%^{1/3}$/tex] | 1595 | 1623 | 1627 | 1603 | 1659 | 1649 | 1620 | 1617 | 1698 |
| Fluff count | 20 | 31 | 23 | 22 | 30 | 26 | 50 | 90 | 110 |
| Ds [%] | 10.4 | 10.3 | 10.3 | 10.8 | 10.6 | 10.4 | 10.6 | 10.6 | 10.5 |
| Comparative example 2 | | | | | | | | | |
| Thread No. | V1 | V2 | V3 | V4 | V5 | V6 | V7 | V8 | V9 |
| Draw ratio | 2.000 | 2.025 | 2.050 | 2.075 | 2.100 | 2.125 | 2.150 | 2.175 | 2.200 |

TABLE 4-continued

Draw ratios, drawing speeds $v_s$, breaking tenacities T, $T \cdot E^{1/3}$ values, fluff counts and Ds values of the inventive polyethylene terephthalate multifilament yarns No. 1-9 and the comparative polyethylene terephthalate multifilament yarns No. V1-V9

| | | | | | | | | | |
|---|---|---|---|---|---|---|---|---|---|
| $v_s$ [m/min] | 6000 | 6000 | 6000 | 6000 | 6000 | 6000 | 6000 | 6000 | 6000 |
| T [mN/tex] | 620 | 628 | 640 | 657 | 635 | 667 | 677 | 681 | 687 |
| $T \cdot E^{1/3}$ [mN % $^{1/3}$/tex] | 1597 | 1582 | 1591 | 1630 | 1535 | 1608 | 1620 | 1607 | 1568 |
| Fluff count | 41 | 32 | 18 | 32 | 41 | 48 | 174 | 877 | 363 |
| Ds [%] | 10.6 | 10.5 | 10.5 | 10.4 | 10.9 | 10.8 | 10.9 | 10.9 | 10.9 |

The comparison of the fluff counts of the yarns 1-9 produced using the inventive method with the fluff indices of the comparative yarns V1-V9 shows that the inventive method almost always results in yarns with a significantly lower fluff count, and hence in a considerably improved running behaviour of the multifilament. Under otherwise identical conditions, the dimensional stability Ds is thereby almost always better than the Ds of the comparative yarns V1-V9.

EXAMPLE 3

Production of Polyethylene Terephthalate Multifilament Yarns with a Yarn Count of 1440 dtex Polyethylene terephthalate granules with a relative viscosity of 2.04 (measured on a solution of 1 g polymer in 125 g of a mixture of 2,4,6-trichlorophenol and phenol (TCF/F, 7:10 m/m) at 25° C. in an Ubbelohde (DIN 51562) viscosimeter) were spun, having selected $\alpha=\beta=90°$, and cooled. As in Example 1, the spun filament bundle runs through a heating tube, then through the immediately adjoining first cooling zone and through the immediately adjoining second cooling zone. The spinning and cooling conditions are summarised in Table 5, whereby the spinning and cooling parameters have the same meaning as in Example 1.

TABLE 5

Spinning and cooling conditions

| | |
|---|---|
| Yarn count | 1440 [dtex] |
| Filament linear density | 4.4 [dtex] |
| Spinneret | |
| Number of holes | 331 |
| Hole diameter | 800 [μm] |
| Length of the heating tube | 150 [mm] |
| Temperature in the heating tube | 200 [° C.] |

TABLE 5-continued

Spinning and cooling conditions

| | |
|---|---|
| First cooling zone | |
| L | 700 [mm] |
| $T_{11}$ | 55 [° C.] |
| $v_{11}$ | 0.60 [m/min] |
| $L_{11}$ | 500 [mm] |
| $T_{12}$ | 55 [° C.] |
| $v_{12}$ | 0.85 [m/min] |
| $L_{12}$ | 200 [mm] |
| V/t | 230 [$m^3$/h] |
| $L_{BX}$ | 160 [mm] |
| $L_{XD}$ | 540 [mm] |
| $L_{BX}$:$L_{XD}$ | 0.30 |
| Second cooling zone | |
| $L_{CE}$ | 500 [mm] |
| $T_2$ | 30 [° C.] |
| $P_1$ | 0.23 |
| $P_2$ | 0.32 |

Immediately after passing through the second cooling zone, the multifilament is bundled and runs through a tube into a drawing device where the multifilament is drawn and wound under the draw ratios listed in Table 6 at a drawing speed of 6000 m/min to produce polyethylene terephthalate multifilament yarns manufactured in a single stage with a yarn count of 1440 dtex whose fluff counts and breaking tenacities, $T \cdot E^{1/3}$ values and dimensional stabilities Ds are also listed in Table 6 (see yarns No. 1-9).

COMPARATIVE EXAMPLE 3

For comparison, the polyethylene terephthalate multifilament yarns No. V1-V9 are produced as in Example 3, but with the difference that in the first cooling zone suction was performed over the whole length BD=L=700 mm.

TABLE 6

Draw ratios, drawing speeds $v_s$, breaking tenacities T, $T \cdot E^{1/3}$ values, fluff counts and Ds values of the inventive polyethylene terephthalate multifilament yarns No. 1-9 and the comparative polyethylene terephthalate multifilament yarns No. V1-V9

| Example 3 | | | | | | | | | |
|---|---|---|---|---|---|---|---|---|---|
| Thread No. | 1 | 2 | 3 | 4 | 5 | 6 | 7 | 8 | 9 |
| Draw ratio | 2.000 | 2.025 | 2.050 | 2.075 | 2.100 | 2.125 | 2.150 | 2.175 | 2.200 |
| $v_s$ [m/min] | 6000 | 6000 | 6000 | 6000 | 6000 | 6000 | 6000 | 6000 | 6000 |
| T [mN/tex] | 631 | 606 | 643 | 660 | 679 | 668 | 684 | 703 | 729 |
| $T \cdot E^{1/3}$ [mN % $^{1/3}$/tex] | 1642 | 1537 | 1633 | 1643 | 1695 | 1661 | 1633 | 1685 | 1672 |

TABLE 6-continued

| Draw ratios, drawing speeds $v_s$, breaking tenacities T, $T \cdot E^{1/3}$ values, fluff counts and Ds values of the inventive polyethylene terephthalate multifilament yarns No. 1-9 and the comparative polyethylene terephthalate multifilament yarns No. V1-V9 | | | | | | | | | |
|---|---|---|---|---|---|---|---|---|---|
| Fluff count | 6 | 10 | 55 | 18 | 10 | 15 | 26 | 17 | 49 |
| Ds [%] | 10.8 | 11.1 | 11.0 | 10.9 | 10.8 | 11.0 | 10.9 | 11.0 | 10.8 |
| | | | | Comparative example 3 | | | | | |
| Thread No. | V1 | V2 | V3 | V4 | V5 | V6 | V7 | V8 | V9 |
| Draw ratio | 2.000 | 2.025 | 2.050 | 2.075 | 2.100 | 2.125 | 2.150 | 2.175 | 2.200 |
| $v_s$ [m/min] | 6000 | 6000 | 6000 | 6000 | 6000 | 6000 | 6000 | 6000 | 6000 |
| T [mN/tex] | 635 | 645 | 659 | 662 | 666 | 670 | 691 | 699 | 701 |
| $T \cdot E^{1/3}$ [mN % $^{1/3}$/tex] | 1620 | 1578 | 1659 | 1868 | 1629 | 1622 | 1654 | 1688 | 1674 |
| Fluff count | 15 | 14 | 53 | 41 | 67 | 32 | 78 | 315 | 212 |
| Ds [%] | 10.7 | 10.7 | 10.6 | 11.0 | 10.8 | 11.1 | 11.1 | 10.9 | 10.8 |

The comparison of the fluff counts of the yarns 1-9 produced using the inventive method with the fluff counts of the comparative yarns V1-V9 shows that the inventive method almost always results in yarns with a significantly lower fluff count, and hence in a considerably improved running behaviour of the multifilament.

The invention claimed is:

1. Method for spinning a multifilament yarn from a thermoplastic material comprising the steps of extruding the melted material through a spinneret to form a filament bundle comprising a plurality of filaments and winding the filament bundle as a multifilament yarn after solidifying, said spinneret having a plurality of spinneret holes and the ends of the holes at which the filaments emerge forming a spinneret hole outlet plane, and with the filament bundle first being cooled below the spinneret in a first cooling zone by means of at least one transverse blowing operation with a gaseous cooling medium and by means of suction on the opposite side to the transverse blowing operation, and then in a second cooling zone below the first cooling zone the filament bundle being further cooled by self suction of gaseous cooling medium in the vicinity of the filament bundle, in the first cooling zone the at least one transverse blowing operation occurs via a blowing section AC of length L with the blowing section AC having an upper leading end A facing towards the spinneret holes and a lower trailing end C facing away from the spinneret holes, and that the blowing section AC is arranged opposite a section BD having a leading end B facing towards the spinneret holes and a trailing end D facing away from the spinneret holes, and that the imaginary line AB between A and B runs parallel to the spinneret hole outlet plane, with section BD having a length L and section BD being divided into an open suction section BX with the length $L_{BX}$ via which the gaseous cooling medium is sucked away and a closed section XD having a length $L_{XD}$, with the $L_{XD}$: $L_{XD}$ ratio lying in the range between 0.15: 1 and 0.5 : 1.

2. Method according to claim 1, wherein the $L_{BX}$: $L_{XD}$ ratio lies in the range between 0.2 : 1 and 0.4 : 1.

3. Method according to claim 1, wherein $L_{BX}$ has a length in the range from 5 cm to 50 cm and $L_{XD}$ a length in the range from 20 cm to 150 cm.

4. Method according to claim 1, wherein the blowing section AC has an angle α of 60° to 90° relative to the imaginary line AB, and the suction section BX has an angle β of 60° to 90° relative to the imaginary line AB.

5. Method according to claim 4, wherein the blowing section AC has an angle αof 90° relative to the imaginary line AB, and the suction section BX has an angle βof 90° relative to the imaginary line AB.

6. Method according to claim 4, wherein the blowing section AC has an angle α of 60° to <90° relative to the imaginary line AB, and the suction section BX has an angle β of 90° relative to the imaginary line AB.

7. Method according to claim 1, wherein the transversely blown gaseous cooling medium in the first cooling zone has a flow velocity between 0.1 and 1 m/s.

8. Method according to claim 1, wherein the gaseous cooling medium is tempered by means of a first temperature control device before it is supplied to the at least one transverse blowing operation in the first cooling zone.

9. Method according to claim 1, wherein in the second cooling zone the filament bundle is guided between perforated materials in such a way that the gaseous cooling medium can contact the filaments from two sides due to the self-suction of the filaments in the filament bundle.

10. Method according to claim 1, wherein the filament bundle is guided through a perforated tube in the second cooling zone.

11. Method according to claim 1, wherein the first cooling zone has a first transverse blowing operation and an immediately adjoining second transverse blowing operation on the blowing section AC, with the first and second transverse blowing operations together having a total length L, and with the first transverse blowing operation being operated with a velocity $v_{11}$ of the gaseous cooling medium and the second transverse blowing operation being operated with a velocity $v_{12}$ of the gaseous cooling medium, with $v_{11}$ being different from $v_{12}$.

12. Method according to claim 1, wherein the first cooling zone has a first transverse blowing operation and an immediately adjoining second transverse blowing operation on the blowing section AC, with the first and second transverse blowing operations together having a total length L, and with the first transverse blowing operation being operated with a temperature $T_{11}$ of the gaseous cooling medium and the second transverse blowing operation being operated with a temperature $T_{12}$ of the gaseous cooling medium, with $T_{11}$ being different from $T_{12}$.

13. Method according to claim 1, wherein the filament bundle in the second cooling zone is further cooled by self-suction of gaseous cooling medium in the vicinity of the filament bundle, with the temperature of the gaseous cooling medium being controlled before entering the second cooling zone.

14. Method according to claim 1, wherein air and/or an inert gas is employed as gaseous cooling medium.

15. Method according to claim 1, wherein a single or multistage drawing of the filaments is performed after cooling of the filament bundle in the second cooling zone and before winding.

16. Method according to claim 1, wherein winding is performed at speeds of at least 2500 m/min.

17. Method according to claim 1, wherein the thermoplastic material is selected from the group consisting of polyester, polyamide, polyolefin and blends or copolymers of these polymers.

18. Method according to claim 1, wherein the thermoplastic material consists essentially of polyethylene terephthalate.

* * * * *

UNITED STATES PATENT AND TRADEMARK OFFICE

CERTIFICATE OF CORRECTION

PATENT NO. : 7,842,208 B2
APPLICATION NO. : 12/452666
DATED : November 30, 2010
INVENTOR(S) : Bastiaan Krins et al.

It is certified that error appears in the above-identified patent and that said Letters Patent is hereby corrected as shown below:

In the Claims

In Col. 15, Line 57, "$L_{XD}$:$L_{XD}$" should be --$L_{BX}$:$L_{XD}$--

Signed and Sealed this
Fourth Day of February, 2014

Michelle K. Lee

Michelle K. Lee
*Deputy Director of the United States Patent and Trademark Office*